US006176049B1

(12) United States Patent
Crant et al.

(10) Patent No.: US 6,176,049 B1
(45) Date of Patent: Jan. 23, 2001

(54) CONCRETE ELEVATION ASSEMBLY, HOLLOW CONCRETE BLOCK, AND METHOD OF MAKING

(75) Inventors: Bruce H. Crant; Greg G. Conley, both of Lexington, KY (US)

(73) Assignee: Step-by-Step Systems, LLC, Minneapolis, MN (US)

( * ) Notice: Under 35 U.S.C. 154(b), the term of this patent shall be extended for 0 days.

(21) Appl. No.: 09/176,869

(22) Filed: Oct. 22, 1998

Related U.S. Application Data

(63) Continuation-in-part of application No. 08/986,453, filed on Dec. 8, 1997.

(51) Int. Cl.[7] ..... E04F 11/116

(52) U.S. Cl. ..... 52/188; 52/189; 52/604; 52/605

(58) Field of Search ..... 52/188, 189, 604, 52/605

(56) References Cited

U.S. PATENT DOCUMENTS

| | | | | |
|---|---|---|---|---|
| 744,887 | | 11/1903 | Walsh . | |
| 1,265,949 | | 5/1918 | Osborn . | |
| 1,404,823 | | 1/1922 | Williams . | |
| 1,475,777 | | 11/1923 | Ballenger . | |
| 1,879,996 | | 9/1932 | Sherwood . | |
| 1,988,492 | | 1/1935 | Henderson . | |
| 2,153,017 | | 4/1939 | Henderson . | |
| 2,374,905 | * | 5/1945 | Wale | 52/189 X |
| 2,392,551 | | 1/1946 | Roe . | |
| 2,644,497 | | 7/1953 | Wilmer et al. . | |
| 2,660,878 | | 12/1953 | Barnhart . | |
| 2,722,823 | | 11/1955 | Summers . | |
| 2,868,008 | | 1/1959 | Toulmin, Jr. . | |
| 2,885,883 | * | 5/1959 | Torricelli | 52/189 X |
| 3,025,639 | | 3/1962 | Lemieux . | |
| 3,416,276 | | 12/1968 | Caputo et al. . | |
| 3,534,518 | | 10/1970 | Zagray . | |
| 3,706,170 | * | 12/1972 | Argraves et al. | 52/189 |
| 4,372,091 | | 2/1983 | Brown et al. . | |
| 4,473,985 | | 10/1984 | Hunt . | |
| 4,569,500 | | 2/1986 | Beede . | |
| 4,639,345 | | 1/1987 | Olsen . | |
| 4,726,567 | | 2/1988 | Greenberg . | |
| 4,802,836 | | 2/1989 | Whissell . | |
| 4,959,003 | | 9/1990 | Gregersen . | |
| 5,098,218 | | 3/1992 | Reese et al. . | |
| 5,379,565 | | 1/1995 | Vienne . | |
| 5,479,746 | | 1/1996 | Mannonen . | |
| 5,507,996 | | 4/1996 | Brouard . | |
| 5,540,869 | | 7/1996 | Aaseth et al. . | |
| 5,571,464 | | 11/1996 | Aaseth et al. . | |
| 5,623,797 | | 4/1997 | Gravier et al. . | |

* cited by examiner

*Primary Examiner*—Christopher T. Kent
(74) *Attorney, Agent, or Firm*—Popovich & Wiles, P.A.

(57) ABSTRACT

In a method for forming a block having a core, the core is formed in a vertical orientation, providing for increased control of wall thickness. The block has a projection on one surface and a groove on an opposing surface. The block core is disposed parallel to the projection and the groove. The block may be used in a step assembly, a ramp assembly, or a wall. Assemblies made from the block are easy to construct and can be assembled with or without adhesive.

4 Claims, 12 Drawing Sheets

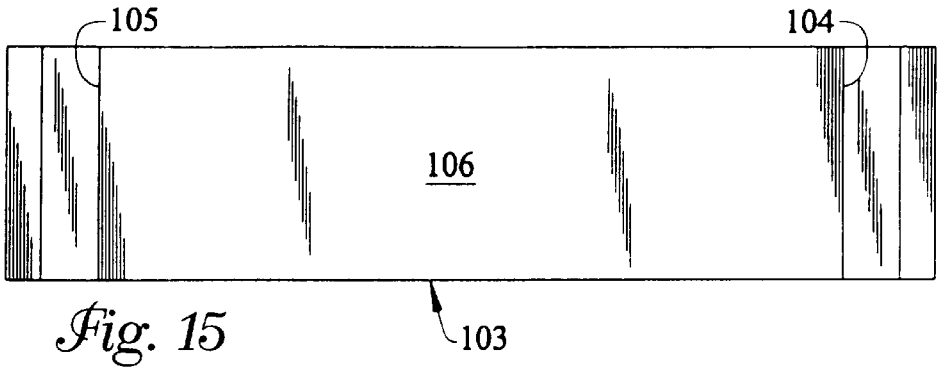
Fig. 15
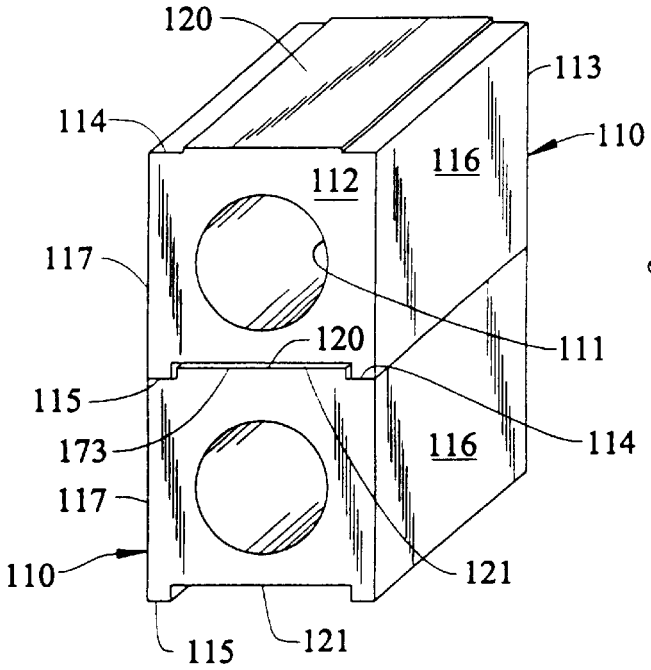
Fig. 16
Fig. 17
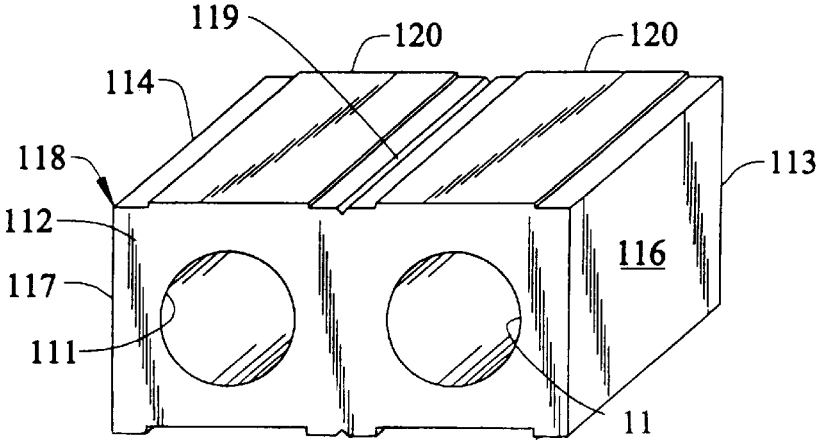

CONCRETE ELEVATION ASSEMBLY, HOLLOW CONCRETE BLOCK, AND METHOD OF MAKING

This is a continuation in part of copending patent application Ser. No. 08/986,453, filed Dec. 8, 1997, of Bruce H. Crant et al.

This invention relates to a concrete elevation assembly formed of components or elements to enable a person to move from one elevation to another, a hollow concrete block utilized as a support for the concrete elevation assembly or as a wall, and a method for forming the hollow concrete block and, more particularly, to a concrete elevation assembly in which the components or elements may be easily assembled by one person in an interlocking relation, a hollow concrete block having the tolerances of its walls parallel to the longitudinal axis of a through passage closely controlled, and a method for forming the hollow concrete block so that its through passage may be disposed horizontal to have the tolerances of its support walls closely controlled.

The concrete elevation assembly may be either a step assembly or a ramp assembly. Each enables a person to move from one elevation to another.

Various step assemblies have previously been suggested in U.S. Pat. No. 744,887 to Walsh, U.S. Pat. No. 1,265,949 to Osborn, U.S. Pat. No. 1,475,777 to Ballenger, U.S. Pat. No. 1,879,996 to Sherwood, U.S. Pat. No. 2,153,017 to Henderson, U.S Pat. No. 2,722,823 to Summers, U.S. Pat. No. 3,025,639 to Lemieux, and U.S. Pat. No. 3,706,170 to Argraves et al. The assembly of each of the aforesaid patents has disadvantages, particularly when the steps are to be assembled by an unskilled artisan such as a do-it-yourself person, who lacks both the knowledge and the tools to perform certain functions such as being able to form cement or mortar.

The aforesaid Walsh patent has risers and treads of steps formed of plastic and relies solely on cementing the risers and the treads to each other to hold them in place. It is not understood how plastic can be cemented to plastic. However, even if it could, a base-wall is formed as a single element beneath the width of the steps or as two elements at opposite sides of the steps. There is no interlocking of any of the risers, treads, and supports therefor in the aforesaid Walsh patent.

The aforesaid patent to Walsh also requires ledges on the inside of the base-wall, if it does not extend completely beneath the step structure, to support the risers, which have a hollow U-shaped cross section with a tread on top thereof.

For the do-it-yourself person, who is not a skilled artisan, the step assembly of the aforesaid Walsh patent would not be easy to form because of the problem of how to support the two base-walls. These would be extremely heavy when made of concrete blocks, for example, as the present invention uses in order to be able to have an easy assembly.

The aforesaid Osborn patent requires the assembly be held by a building. This requirement would prevent a do-it-yourself person from being able to utilize the structure of the aforesaid Osborn patent.

In addition, the aforesaid patent to Osborn has a complex arrangement for connecting risers, treads, and stringers to each other. This requires fresh cement to be poured in openings in the bottom surface of the tread registering with elongated openings in the stringers and an elongated opening in the top of the riser registering with a longitudinal opening in the bottom surface of the tread. This mixed fresh cement is normally not within the capabilities of a do-it-yourself person.

The step assembly of the aforesaid Ballenger patent also requires its connection to a building wall through a connector having a hook supporting the lowermost of the risers. The risers are supported solely by the treads of adjacent steps except for the lowermost of the risers. This prevents a free-standing step assembly.

The aforesaid patent to Sherwood has relatively large end rest members supporting opposite ends of each tread of a step assembly. During assembly, tie rods hold the end rest members together. Mortar also is required; this is not within the skill of most do-it-yourself persons.

Furthermore, the aforesaid Sherwood patent forms the risers with brackets to support the bottom of the treads, which are attached to the end rest members. However, there is no connection between the tops of the risers and the treads. Thus, the aforesaid patent to Sherwood has a rather expensive step assembly that cannot be formed by a do-it-yourself person.

The aforesaid Henderson patent employs hollow concrete blocks on which treads may rest with their ends supported by risers, which are supported by the hollow concrete blocks having vertical through passages. The risers and the treads are mortared to each other. The treads are supported intermediate two end sets of hollow concrete blocks by straps or plates, which are supported by the risers.

The aforesaid patent to Henderson lacks any means for properly aligning the elements together during assembly. Mortar is also required, and this is not satisfactory for a do-it yourself person. Furthermore, the size of the concrete blocks is larger than any present building code as to height of a step.

The aforesaid Summers patent has relatively large side pieces, which would be difficult to handle if formed of concrete, for example, and requires tensioning rods to hold the assembly together. There is no direct connection of the risers and the treads although there are interlocking arrangements between the side sections and the treads and between the side sections and the risers. Mortar also is required to be in position prior to and after the assembly procedure is completed for the structure to be substantially integral. There also is a requirement for a tapered key to hold the tread in a locked position. This is a rather complex and expensive assembly. Because of the use of mortar, a do-it-yourself person could not effectively construct the assembly of the aforesaid patent to Summers.

The aforesaid Lemieux patent has stringers with tie rods connecting them together. Risers have their bottoms seated in notches in the stringers as are depending flanges on the rear of the treads. There is no interlocking of the treads to the risers or the stringers except for the disposition of the flange on the rear of each of the treads within the notch, which also receives the lower end of the riser supporting the tread thereabove.

The step assembly of the aforesaid patent to Argraves et al has no interlocking elements and requires both mortar and bolts to hold the assembly together. Mortar or other bonding agent connects a reduced portion of each tread to side members, which are stamped to look like individual pieces and have mortar applied in grooves formed thereby. Mortar also is required to be applied over the bolts.

The present invention satisfactorily overcomes the problems of the aforesaid patents through enabling a concrete step assembly to be easily erected by a do-it-yourself person. There is no requirement for mixing with any cement or other materials.

Instead, only a construction adhesive, which may be easily applied by a do-it-yourself person through a caulking gun, is used.

Furthermore, an interlocking arrangement between the risers and the treads insures that each of the risers is positively locked or held in position.

The concrete elevation assembly of the present invention also may be formed as a concrete ramp assembly. The ramp assembly employs concrete support elements with each having only its top surface inclined and support structures for the concrete elements similar to the support structures of the concrete step assembly and having an interlocking arrangement with the concrete support elements.

The ramp assembly also may be formed with intermediate support elements disposed on substantially horizontal upper surfaces of concrete blocks with the intermediate support elements having an inclined upper surface and a horizontal lower surface, which rests on the substantially horizontal upper surface of each of the concrete blocks supporting it. Each of the intermediate support elements has an interlocking relation with each of the concrete blocks supporting it.

The inclined upper surface of each of the intermediate support elements supports planks, which have substantially parallel upper and lower walls. There is an interlocking relation between the inclined upper surface of each of the intermediate support elements and each of the planks supported thereby.

The invention contemplates preferably using only two different intermediate support elements with each having the same length. The two different intermediate support elements for the lowest portion of the ramp are supported on a single course of concrete blocks at least on each side of the ramp assembly. The next two different intermediate support elements are supported at least on each side on the substantially horizontal upper surface of each of the upper courses of two courses of concrete blocks. If more than four of the intermediate support elements are required at least on each side to support the planks, the next two different intermediate support elements would be supported on top of three courses of concrete blocks at least on each side.

Thus, utilization of an increasing number of courses of staggered concrete blocks for each pair of the two different intermediate support elements enables the use of only two different intermediate support elements as part of the ramp assembly. This reduces manufacturing costs.

In the preferred embodiment, the smaller of the two different intermediate support elements has a relatively small thickness such as 1", for example, at its thinner end between its inclined upper surface and its horizontal lower surface and a thickness of 4" at its thicker end. The larger of the two different intermediate support elements is formed with the same thickness of 4", for example, at its thinner end and a thickness of 7" at its thicker end. Therefore, there is a 3" variation between the ends of each of the two different intermediate support elements. By having the adjacent ends of the two different intermediate support elements with the same thickness, a smooth inclined surface is produced by the planks, which preferably have a thickness of 2", supported by the two different intermediate support elements.

Additionally, because the concrete blocks have a thickness of 6", the smaller intermediate support element with the 1" thickness at one end provides a total of 7" when disposed on a second course of the concrete blocks. That is, the concrete block thickness of 6" plus the 1" thickness at the thinner end of the smaller intermediate support element equals the 7" thickness at the thicker end of the larger intermediate support element against which the thinner end of the smaller intermediate support element abuts when supported by each of the second courses of the staggered concrete blocks.

The interlocking relation between the concrete blocks and the two different intermediate support elements is preferably provided by a single, relatively wide projection extending upwardly from the horizontal upper surface of each of the supporting concrete blocks being disposed within a relatively wide channel or groove in the horizontal lower surface of the smaller or larger intermediate support element. Similarly, the inclined upper surface of each of the larger and smaller intermediate support elements has a relatively wide projection for disposition in a relatively wide channel or groove in the lower surface of each plank, which it supports, on each side thereof.

This arrangement of the single projection and channel, symmetrically located, enables the intermediate support elements, the concrete blocks, and the planks to be interchangeable. This reduces the costs of manufacture and inventory.

The concrete blocks are preferably hollow concrete blocks having a horizontal passage extending therethrough. The walls of the hollow concrete block between which the through passage extends cannot have their tolerances closely controlled. This is because these two walls have movable elements (a press head and a pallet) of a block machine, which forms the hollow concrete block, pushing on the concrete material to form the hollow concrete block since all available block machines have the passage vertically disposed during formation.

The method of the present invention controls the tolerances of the walls parallel to the longitudinal axis of the horizontal through passage in the hollow concrete block. As a result, horizontal surfaces of the walls fit against the horizontal bottom surface of the intermediate support elements, which are wet cast, so that there is no space or gap therebetween requiring mortar to close as is presently required with hollow concrete blocks having the through passage disposed vertically.

Likewise, when the hollow concrete blocks are stacked on each other in a staggered relation, the horizontal surfaces of the engaging walls of two vertically spaced hollow concrete blocks fit tightly because of the controlled tolerances. This allows the hollow concrete blocks to be arranged in stacked courses as supports for the elevation assemblies of the present invention or as a wall without the need of any mortar. That is, when the hollow concrete blocks have previously been utilized with the through passage vertical as it is formed, the tolerance of neither of the walls, which are horizontal when the passage is vertical, between which the through passage extends can be satisfactorily controlled. As a result, mortar, which requires a skilled artisan for application, has to be utilized to compensate for this lack of tolerance control of the walls defining the top and bottom walls of each of the hollow concrete blocks when the through passage is vertical.

The use of the hollow concrete blocks also reduces the weight in forming the supports of the concrete elevation assemblies of the present invention. The hollow concrete blocks are much easier to handle than solid concrete blocks because of the reduced weight.

It has previously been suggested in U.S. Pat. No. 3,416,276 to Caputo et al to dispose hollow concrete blocks with passages extending horizontally therethrough. The aforesaid Caputo et al patent also recognized the need to avoid the use of mortar in joining the hollow concrete blocks to each other to form a plurality of staggered courses of the hollow concrete blocks forming a masonry wall, for example, to enable an unskilled person to erect the wall.

In the aforesaid Caputo et al patent, a top surface of each of the hollow concrete blocks has an arcuate central portion forming an arcuate tongue for cooperation with an arcuate groove in the same area of the bottom surface of a hollow concrete block thereabove. Each of the top and bottom surfaces includes a substantially flat surface on each side between which the arcuate tongue or arcuate groove extends. The flat surfaces on the top surface of one of the hollow concrete blocks engage the corresponding flat surfaces on the bottom surface of the hollow concrete block thereabove.

Prior to placing a hollow concrete block on top of a lower hollow concrete block in the aforesaid Caputo et al patent, an adhesive mortar is preferably laid in beads on the substantially flat surfaces of the top surface. Alternatively, the adhesive mortar could be applied in separate and discrete globs or with brushes, knives, or rollers.

While the aforesaid Caputo et al patent recognized that the adhesive mortar must be applied in minimal quantities so that no excess appears on the outer surfaces of the hollow concrete block or in the joints between the hollow concrete blocks, there is no explanation of how this minimum quantity can be controlled and still obtain good adherence between the hollow concrete blocks. For example, if more than a very slight amount of the adhesive mortar is applied, the substantially flat surfaces on the adjacent vertically stacked hollow concrete blocks will not touch each other but have at least a minimum space therebetween. If not enough of the adhesive mortar is applied to insure that the substantially flat surfaces engage, there may not be sufficient adhesive to join the hollow concrete blocks.

The present invention overcomes the foregoing problems of the aforesaid Caputo et al patent through controlling the height of the projection relative to the depth of the channel or groove in which the projection is disposed when two of the hollow concrete blocks are vertically stacked on each other. By controlling the spacing between the top of the projection and the base of the channel or groove, the amount of adhesive utilized to join the adjacent vertically disposed hollow concrete blocks is controlled.

Additionally, the present invention locates the area in which the adhesive is applied away from the outer surfaces of the hollow concrete block rather than adjacent thereto as in the aforesaid Caputo et al patent. This avoids the problem of the aforesaid Caputo et al patent of the engaging substantially flat surfaces of the adjacent vertically disposed hollow concrete blocks not having complete contact with each other. Furthermore, since the present invention controls the tolerances of these engaging flat surfaces, there will always be engagement therebetween because the amount of adhesive between the top of the projection and the base of the channel or groove is controlled.

An object of this invention is to provide a concrete step assembly capable of being assembled by an unskilled person.

Another object of this invention is to provide a concrete ramp assembly capable of being assembled by an unskilled person.

A further object of this invention is to provide a ramp assembly requiring only four different parts irrespective of the length of the ramp assembly.

Still another object of this invention is to provide a ramp assembly requiring only two different inclined elements irrespective of the length of the ramp assembly.

A still further object of this invention is to provide a method for forming a hollow concrete block with relatively close tolerances of its walls parallel to the longitudinal axis of its through passage.

Yet another object of this invention is to use hollow concrete blocks as the supports for a concrete elevation assembly.

Other objects of this invention will be readily perceived from the following description, claims, and drawings.

The attached drawings illustrate preferred embodiments of the invention, in which:

FIG. 15 is a bottom plan view of a plank of the concrete ramp assembly of FIG. 13;

FIG. 16 is a perspective view of two hollow concrete blocks in a stacked relation for forming supports for the concrete elevation assemblies of the present invention;

FIG. 17 is a perspective view of a hollow concrete block utilized to form a wall and from which two of the hollow concrete blocks of FIG. 16 are preferably formed;

Figure 1:
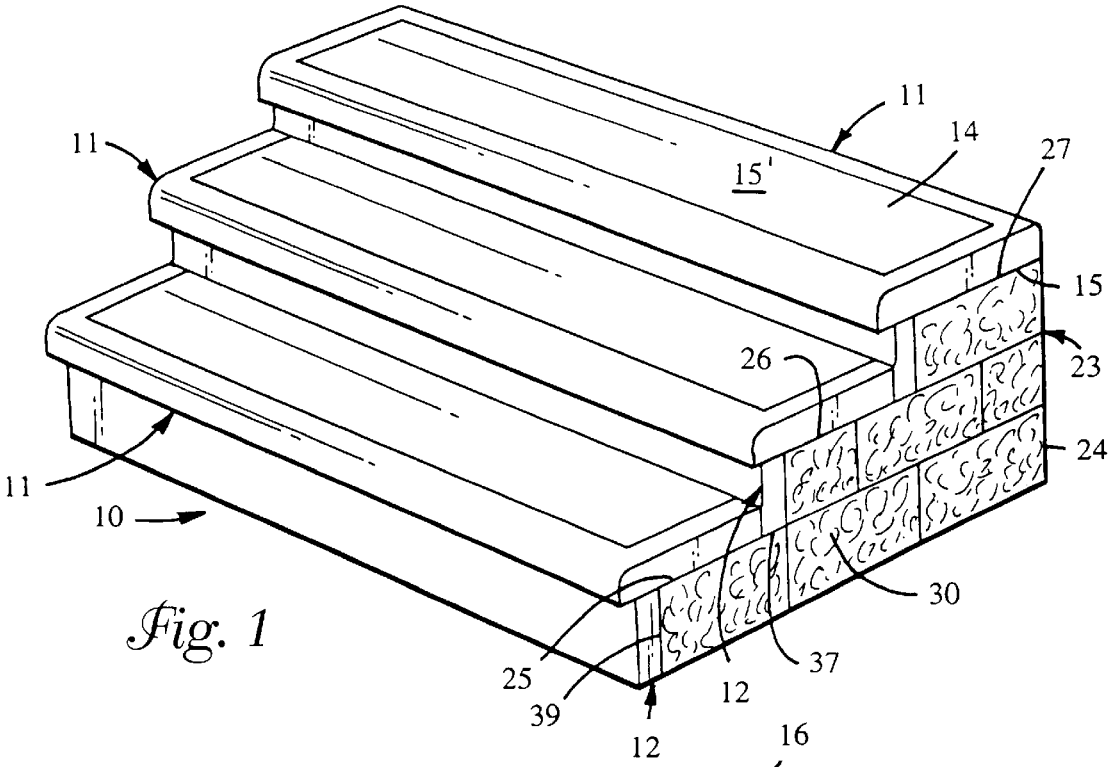
FIG. 1 is a perspective view of a concrete step assembly of the present invention.

Referring to the drawings and particularly FIG. 1, there is shown a step assembly 10 having a plurality of treads 11 and an equal number of risers 12 cooperating therewith. Each of the treads 11 and the risers 12 is formed of reinforced concrete in which at least one reinforcing bar is embedded in the concrete.

Each of the treads 11 has an upper surface 14 and a lower surface 15, which is substantially parallel to a main portion 15' of the upper surface 14. While the upper surface 14 is curved along its edges to form the main portion 15', the surfaces 14 and 15 are substantially planar.

Figure 2:
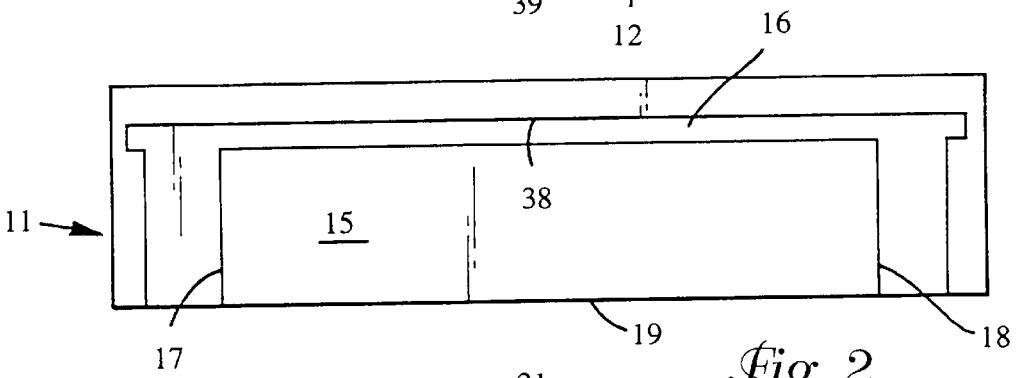
FIG. 2 is a bottom plan view of a tread of the concrete step assembly of FIG. 1.

As shown in FIG. 2, the lower surface 15 of the tread 11 has a longitudinal receptacle 16 formed therein and terminating prior to each side of the tread 11. The lower surface 15 also has two substantially parallel transverse receptacles 17 and 18 communicating with the longitudinal receptacle 16 and extending substantially perpendicular thereto from a rear edge 19 of the tread 11.

Figure 3:
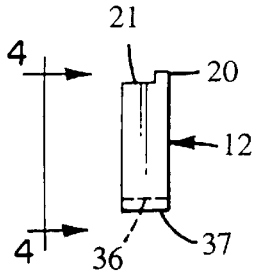
FIG. 3 is a side elevational view of a riser of the concrete step assembly of FIG. 1.

The longitudinal receptacle 16 receives a longitudinal projection 20 (see FIG. 3) extending upwardly from a flat upper surface 21 of the riser 12. The flat upper surface 21 of the riser 12 has a substantially greater horizonal surface area than the longitudinal projection 20. The flat upper surface 21 of the riser 12 preferably has a horizonal surface area at least seven times greater than the horizonal surface area of the longitudinal projection 20.

The longitudinal projection 20 of the riser 12 not only has a tight fit within the longitudinal receptacle 16 (see FIG. 2) in the tread 11 but also is positively retained therein by a construction adhesive, which is designed for use with concrete. The preferred construction adhesive is sold by Keystone Retaining Walls Systems,Inc., 4444 West 78th Street, Minneapolis, Minn. under the trade name Kapseal adhesive.

The concrete step assembly 10 (see FIG. 1) includes a pair of supports 23 (one shown), which are substantially parallel to each other and support opposite sides of each of the treads 11 and the risers 12. Each of the supports 23 is the same and includes a plurality of solid concrete blocks 24 arranged in staggered relation to form a plurality of substantially horizontal upper surfaces 25, 26, and 27, for example, of each of the supports 23. The number of the substantially horizontal upper surfaces 25, 26, and 27 would equal the number of the steps in the concrete step assembly 10. Each of the substantially upper horizontal surfaces 25, 26, and 27 of one of the supports 23 is in the same plane as the same substantially horizontal upper surface of the other of the supports 23.

The support 23 has three of the solid concrete blocks 24 forming its bottom row, one of the solid concrete blocks 24 and a half of each of two of the solid concrete blocks 24 forming its intermediate row, and one of the solid concrete blocks 24 forming its top row. The intermediate row could have two of the solid concrete blocks 24 but the preferred form is that shown to provide a better aesthetic appearance.

Each of the solid concrete blocks 24 has a stone face 30. This also is for aesthetic appearance.

Figure 5:
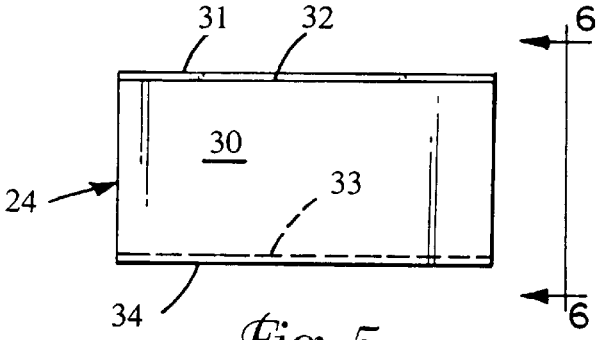
FIG. 5 is a front elevational view of a solid concrete block used as part of a support of the concrete step assembly of FIG. 1.
Figure 6:
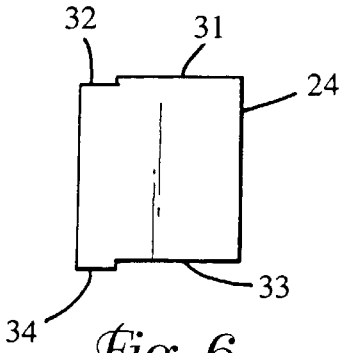
FIG. 6 is a side elevational view of the solid concrete block of FIG. 5 and taken along line 6—6 of FIG. 5.

As shown in FIG. 6, the solid concrete block 24 has a projection 31 extending upwardly from its upper surface 32. As shown in FIG. 5, the projection 31 extends for the entire length of the solid concrete block 24 and four-fifths of the width of the solid concrete block 24 as shown in FIG. 6.

The solid concrete block 24 also has a groove 33 in its bottom surface 34 extending for the same width as the projection 31 and formed to receive the projection 31 on the upper surface 32 of the solid concrete block 24 therebeneath. As shown in FIG. 5, the groove 33 also extends for the length.

The solid concrete blocks 24 (see FIG. 1) in the intermediate row of each of the supports 23 has the grooves 33 (see FIG. 6) receive the projections 31 on the solid concrete blocks 24 in the bottom row. The same arrangement exists between the top row and the intermediate row. The construction adhesive is utilized to retain the projections 31 in the grooves 33.

Each of the transverse receptacles 17 (see FIG. 2) and 18 in the lower surface 15 of each of the treads 11 receives a portion of the projection 31 (see FIG. 6) on one of the solid concrete blocks 24 forming the substantially horizontal upper surfaces 25 (see FIG. 1), 26, and 27 of each of the supports 23. The projections 31 (see FIG. 6) on the solid concrete blocks 24 are held in the transverse receptacles 17 (see FIG. 2) and 18 in the lower surface 15 of each of the treads 11 by the construction adhesive.

The portions of the projections 31 (see FIG. 6) on the solid concrete blocks 24 forming the substantially horizontal upper surfaces 26 (see FIG. 1) and 27 of each of the supports 23 abut the longitudinal projection 20 (see FIG. 3) extending from the flat upper surface 21 of each of the risers 12 resting on the substantially horizontal upper surfaces 25 (see FIG. 1) and 26 and disposed within the longitudinal receptacle 16 (see FIG. 2) in the lower surface 15 of the tread 11 resting on the riser 12.

Figure 4:
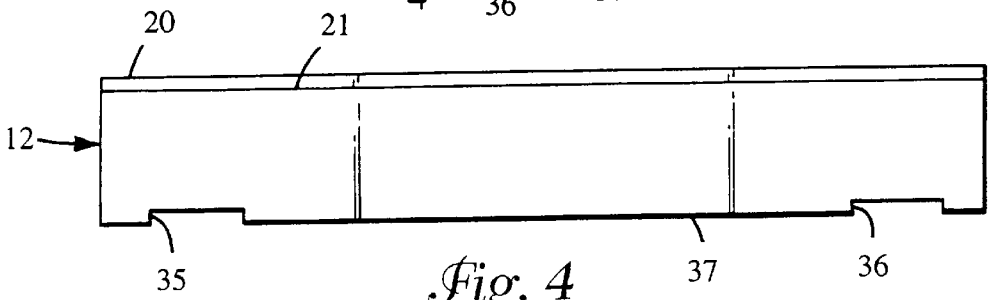
FIG. 4 is a front elevational view of the riser of FIG. 3 and taken along line 4—4 of FIG. 3.

Each of the risers 12 (see FIG. 4) has a pair of slots 35 and 36 formed in its lower surface 37 to receive the remaining portion of the projection 31 (see FIG. 6) on one of the solid concrete blocks 24 of each of the supports 23 on which the lower surface 37 (see FIG. 4) of the riser 12 rests. The projections 31 (see FIG. 6) on the solid concrete blocks 24 are held in the slots 35 (see FIG. 4) and 36 formed in the lower surface 37 of the riser 12 by the construction adhesive.

This arrangement holds the longitudinal projection 20 (see FIG. 4) on the riser 12 against a surface or wall 38 (see FIG. 2) of the longitudinal receptacle 16 in the lower surface 15 of the tread 11. Without this arrangement, the riser 12 (see FIG. 1) might not be retained in its desired position on each of the supports 23.

The lowermost of the risers 12 (see FIG. 1) does not rest on one of the supports 23 but abuts an end surface 39 of the solid concrete block 24 of each of the supports 23 having the upper surface 32 (see FIG. 6) constitute the substantially horizontal upper surface 25 (see FIG. 1) of each of the supports 23. The lowermost of the risers 12 rests on crushed stone, for example.

As an example, the tread 11 (see FIG. 2) has a length of 48", a thickness of 2", and extends for 12 ½" from its front to its back. The longitudinal receptacle 16 in the bottom surface of the tread 11 extends for 44". Each of the transverse receptacles 17 and 18 in the bottom surface 15 of the tread 11 has a length of 6" and a width of 4".

The riser 12 (see FIG. 3) has a length of 46", and a height of 6 ½". The width of the riser 12 is 2" with the longitudinal projection 20 having a width of ¼" and the flat upper surface 21 of the riser 12 having a width of 1 ¾". Each of the slots 35 (see FIG. 4) and 36 in the lower surface 37 of the riser 12 is 4" wide. The slots 35 and 36 extend for the entire length of the riser 12.

Each of the solid concrete blocks 24 (see FIG. 5) has a length of 11 ½", a height of 6", and a depth of 5". Each of the projections 31 (see FIG. 6) on the solid concrete blocks 24 and each of the grooves 33 in the solid concrete blocks 24 have a width of 4" and extend for 11 ½".

Figure 7:
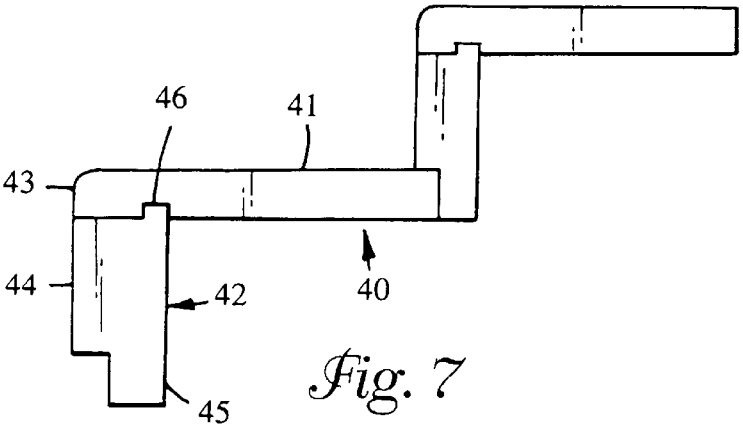
FIG. 7 is a side elevational view of a portion of a concrete step assembly in which the treads do not extend beyond the risers.

Referring to FIG. 7, there is shown a portion of a concrete step assembly 40 in which a tread 41 does not extend beyond a riser 42 but has its front end 43 aligned with a front surface 44 of the riser 42. One means of forming this arrangement is to thicken a portion of the riser 42 to form the front surface 44 so that it is in the same vertical plane as the front end 43 of the tread 41. As an example, the thickened portion of the riser 42 would be 2 ⅝" and a bottom portion 45 of the riser 42 would be 2" thick and extend upwardly for 2". The riser 42 would still extend for the same height as the riser 12 (see FIG. 3) and would have a longitudinal projection 46 (see FIG. 7) of the same width as the longitudinal projection 20 (see FIG. 3) on the riser 12.

Figure 8:
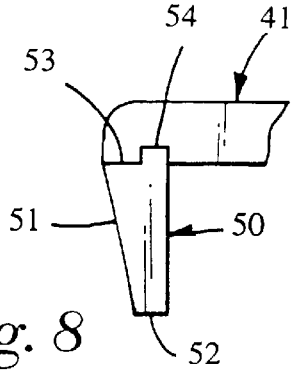
FIG. 8 is a side elevational view of another form of riser in which the tread does not extend beyond the riser.

Referring to FIG. 8, there is shown a riser 50 having its thickness increase along a curved surface 51 from its bottom surface 52 prior to reaching its upper flat surface 53 on which the tread 41 would rest. The upper flat surface 53 would extend for 2 ⅜" from its longitudinal projection 54, which has a width of ¼". In this arrangement, the tread 41 would not extend beyond the flat upper surface 53 of the riser 50.

Figure 9:
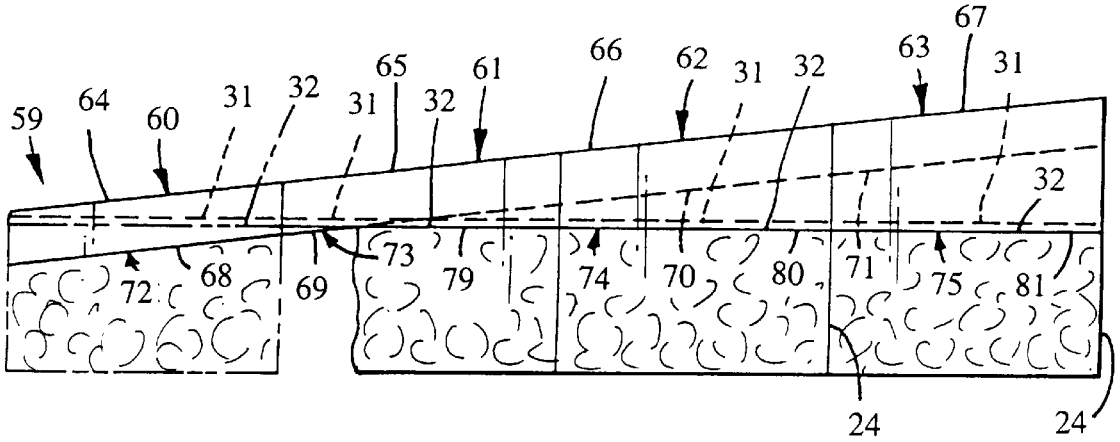
FIG. 9 is a side elevational view of a ramp assembly utilizing solid concrete blocks as supports for reinforced concrete slabs forming the ramp with the leftmost solid concrete block shown in phantom for clarity purposes and the adjacent solid cement block broken away for clarity purposes.

Referring to FIG. 9, there is shown a concrete ramp assembly 59 formed of four reinforced concrete slabs 60, 61, 62, and 63. Each of the slabs 60–63 increases the elevation of the ramp formed thereby so that there is an elevation increase of 5.5" from the front of the slab 60 to the rear of the slab 63.

The slab 60 has an elevation increase of 1" while each of the slabs 61–63 increases 1.5". The slab 60 has its front end raised 0.5" to avoid chipping of its lip by traffic passing over it.

Each of the slabs 60, 61, 62, and 63, respectively, has its entire top surface 64, 65, 66, and 67, respectively, inclined at the same angle. Thus, the top surfaces 64–67 form a continuous inclined surface of the ramp assembly 59.

Each of the slabs 60, 61, 62, and 63, respectively, has a middle portion 68, 69, 70, and 71, respectively, of its bottom surface 72, 73, 74, and 75, respectively, inclined at the same angle as the top surfaces 64, 65, 66, and 67, respectively. Therefore, each of the middle portions 68, 69, 70, and 71, respectively, of the bottom surfaces 72, 73, 74, and 75, respectively, is substantially parallel to the top surfaces 64, 65, 66, and 67, respectively.

Figure 10:
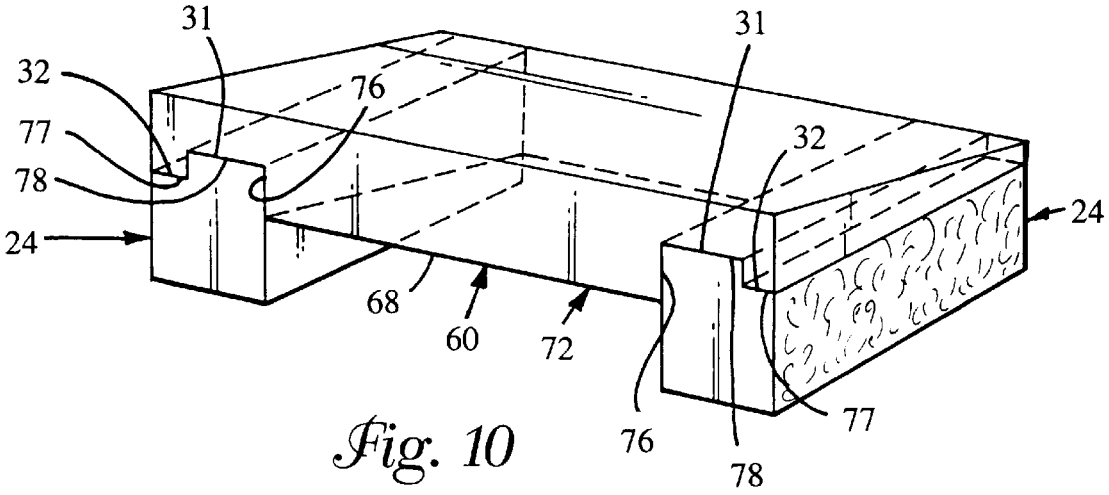
FIG. 10 is a perspective view of a front ramp slab of the four ramp slabs forming the ramp or a portion thereof depending on its length.

As shown in FIG. 10, the slab 60 rests on a pair of the solid concrete blocks 24. The longitudinal projection 31 on each of the solid concrete blocks 24 extends into one of a pair of longitudinal receptacles, which are slots 76 in outer portions 77 of the bottom surface 68 and extending the length of the slab 60. Each of the slots 76 has its upper surface 78, which is substantially horizontal, engaging the top of the longitudinal projection 31 on one of the solid concrete blocks 24.

Each of the outer portions 77 of the bottom surface 68 of the slab 60 rests on the upper surface 32 of one of the solid concrete blocks 24. Thus, the bottom surface 72 of the slab 60 has the outer portions 77 and the upper surfaces 78 of the slots 76 forming substantially horizontal surfaces and the middle portion 68 forming an inclined surface parallel to the top surface 64 (see FIG. 9) of the slab 60.

The slabs 61–63 also are supported on the solid concrete blocks 24 with each of the solid concrete blocks 24 having their upper surfaces 32 in the same substantially horizontal plane and the top surfaces of the longitudinal projections 31 in the same substantially horizontal plane. Accordingly, in the same manner as the slab 60, each of the bottom surfaces 73, 74, and 75, respectively, of the slabs 61, 62, and 63, respectively, has its outer portions 79, 80, and 81, respectively, substantially horizontal.

Furthermore, each of the slabs 60, 61, 62, and 63 must have a minimum thickness of 2" between the top surfaces 64, 65, 66, and 67, respectively, and the middle portions 68, 69, 70, and 71, respectively, of the bottom surfaces 72, 73, 74, and 75, respectively, to provide sufficient reinforced concrete for support of a user of a ramp formed by the slabs 60–63. Because of this requirement, the distance between the top surface 64 and the middle portion 68 of the bottom surface 72 of the slab 60 is sufficiently thick, as shown in FIG. 10, to form the longitudinal slots 76.

Figure 11:
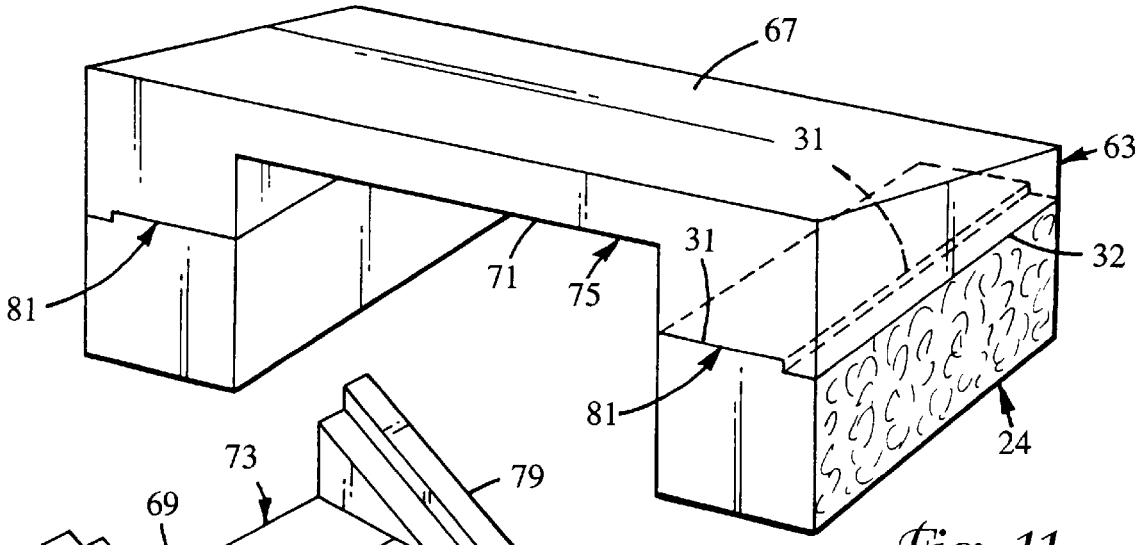
FIG. 11 is a perspective view of the rear ramp slab of the four ramp slabs forming the ramp or a portion thereof depending on its length.

As shown in FIG. 11, there is no receptacle in the bottom surface 75 of the slab 63 to receive the longitudinal projections 31 of the solid concrete blocks 24. This is because there is sufficient thickness (4.5") between the inclined top surface 67 and the inclined middle portion 71 of the bottom surface 75 of the slab 63. The slab 62 (see FIG. 9) has this arrangement too since its minimum thickness between the inclined top surface 66 and the inclined middle portion 70 of the bottom surface 74 is 3'9.

Figure 12:
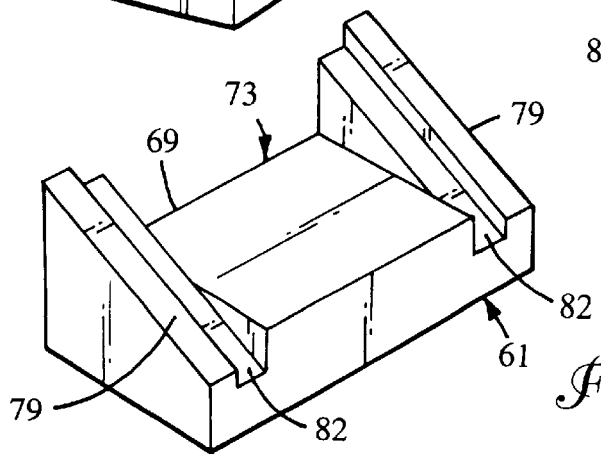
FIG. 12 is a perspective view of a ramp slab next to the front ramp slab of FIG. 10 and looking at the slab inverted and from its front.

However, the slab 61 has its thickness vary from 1.5" at its front or lower end to 3" at its rear or upper end. The two outer portions 79 (see FIG. 12) of the bottom surface 73 rest on the solid concrete block 24 (see FIG. 9) therebeneath throughout their lengths.

There is an increased thickness at the front or lower end of the middle portion 69 of the bottom surface 73 (see FIG. 12) of the slab 61 so that the front of the middle portion 69 of the bottom surface 73 has a thickness of 2". Thus, the increased thickness at the front of the middle portion 69 of the bottom surface 73 of the slab 61 creates longitudinal receptacles 82 corresponding to the longitudinal receptacles 76 (see FIG. 10) in the slab 60. This is because the middle portion 69 (see FIG. 12) of the bottom surface 73 of the slab 61 is lower than the outer portions 79 of the bottom surface 73.

It should be understood that more than one set of the slabs 60–63 may be used to form the ramp. It also is not necessary for the last set of the slabs 60–63 to include all four of the slabs 60–63 as this would depend upon the length of the ramp.

Figure 13:
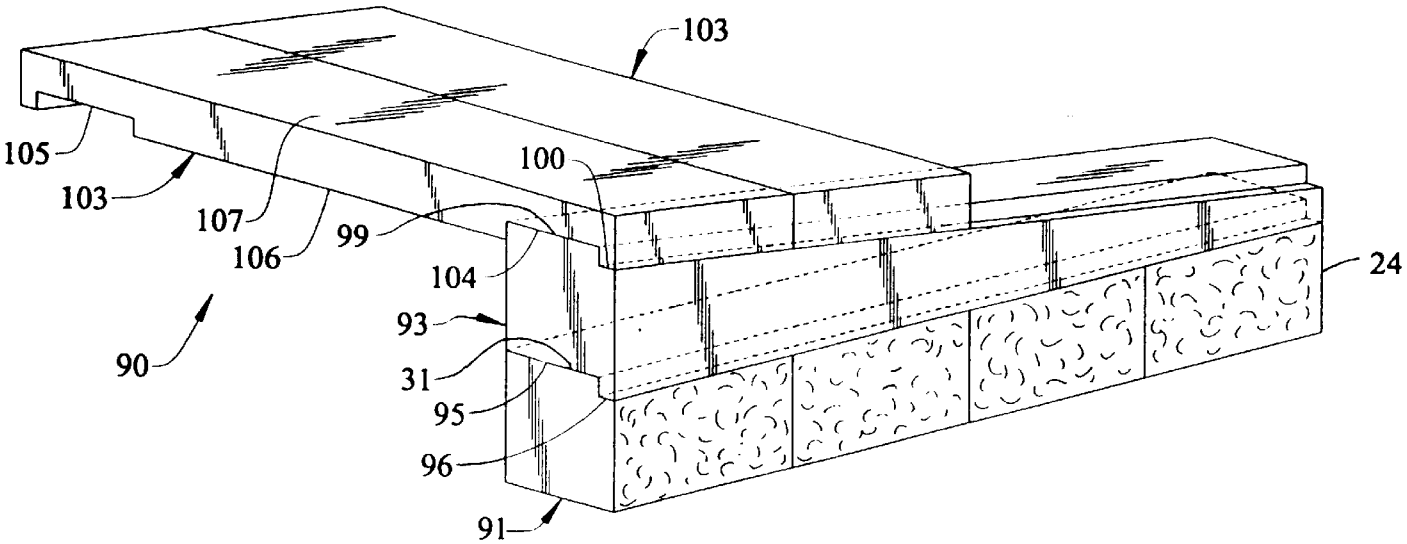
FIG. 13 is a perspective view of a portion of another form of a concrete ramp assembly of the present invention.
Figure 14:
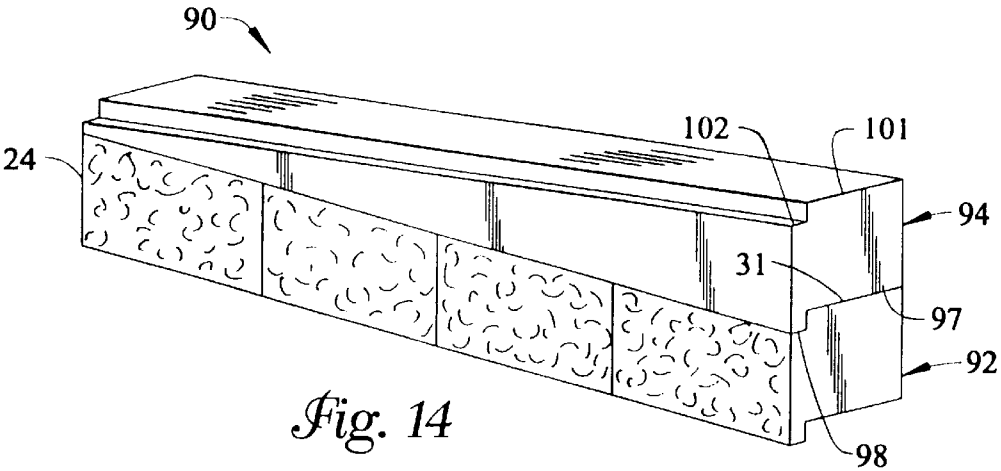
FIG. 14 is a perspective view of the remainder of the concrete ramp assembly of FIG. 13.

Referring to FIGS. 13 and 14, there is shown a concrete ramp assembly 90 using the solid concrete blocks 24 as the base of supports 91 and 92 on opposite sides of the concrete ramp assembly 90. The support 91 (see FIG. 13) has a coping 93 supported on top of the solid concrete blocks 24, and the support 92 (see FIG. 14) has a coping 94 supported on top of the solid concrete blocks 24.

The coping 93 (see FIG. 13) has a longitudinal receptacle 95 in its substantially horizontal bottom surface 96 to receive the longitudinal projection 31 extending upwardly from each of the solid concrete blocks 24. Similarly, the coping 94 (see FIG. 14) has a longitudinal receptacle 97 in its substantially horizontal bottom surface 98 to receive the longitudinal projection 31 extending upwardly from each of the solid concrete blocks 24.

The coping 93 (see FIG. 13) has a longitudinal projection 99 extending upwardly from its inclined upper surface 100.

Likewise, the coping 94 (see FIG. 14) has a longitudinal projection 101 extending upwardly from its inclined upper surface 102. Each of the inclined upper surfaces 100 (see FIG. 13) and 102 (see FIG. 14) is inclined at the same angle as the inclined support surface of the ramp assembly 59 (see FIG. 9).

As shown in FIG. 13, a plurality (two shown) of planks 103 is supported on the inclined upper surfaces 100 and 102 (see FIG. 14). As shown in FIG. 15, each of the planks 103 has a pair of parallel transverse slots 104 and 105 in its bottom surface 106.

One of the transverse slots 104 and 105 of each of the planks 103 receives a portion of the longitudinal projection 99 (see FIG. 13) on the inclined upper surface 100 of the coping 93. The other of the transverse slots 104 and 105 of each of the planks 103 receives a portion of the longitudinal projection 101 (see FIG. 14) on the inclined upper surface 102 of the coping 94.

The plank 103 (see FIG. 13) has its top surface 107 substantially parallel to the bottom surface 106. Thus, the inclination of the support surface of the ramp assembly 90 for a user is determined by the angle of the inclined upper surfaces 102 (see FIG. 14) and 104 (see FIG. 13), which have the same angle. It should be understood that there are preferably four of the planks 103 supported by the supports 91 and 92 (see FIG. 14). However, there could be less than four of the planks 103 (see FIG. 13) or more than four of the planks 103, if desired.

Instead of using the solid concrete blocks 24 (see FIG. 1) for forming each of the supports 23, 91 (see FIG. 13), and 92 (see FIG. 14), hollow concrete blocks 110 (see FIG. 16) may be employed to form the supports 23 (see FIG. 1), 91 (see FIG. 13), and 92 (see FIG. 14). The hollow concrete block 110 (see FIG. 16) has a passage 111 extending therethrough between end walls 112 and 113.

Each of a top wall 114, a bottom wall 115, and side walls 116 and 117 extends substantially parallel to the longitudinal axis of the through passage 111. The tolerance of each of the four walls 114–117 may be very closely controlled when forming the hollow concrete block 110 with the through passage 111 formed vertically as is required by presently available block machines.

Therefore, when one of the hollow concrete blocks 110 is disposed on top of another, the top wall 114 of the lower hollow concrete block 110 abuts the bottom wall 115 of the higher hollow concrete block 110 without any space therebetween because of the closely controlled tolerances of the walls 114 and 115. This eliminates the requirement for mortar to join the stacked hollow concrete blocks 110 together as is required if the through passage 111 were vertically disposed. This is because the tolerance of neither of the end walls 112 and 113, which would be the top and bottom walls if the through passage 111 were vertically disposed, can be closely controlled when the hollow concrete blocks 110 are formed with the passage 111 disposed vertically.

The hollow concrete blocks 110 are preferably formed by splitting a hollow concrete block 118 (see FIG. 17) along a V-shaped score line 119 in each of the top wall 114 and the bottom wall 115 of the hollow concrete block 118 into two of the hollow concrete blocks 110 (see FIG. 16). A hydraulic block splitter is preferably employed to split the hollow concrete block 118 (see FIG. 17).

Each of the hollow concrete blocks 118 is preferably formed with two projections 120 extending upwardly from the top wall 114 and two channels or grooves 121 in the bottom wall 115. There also are two of the passages 111 extending between the walls 112 and 113 in the hollow concrete block 118.

Figure 25:
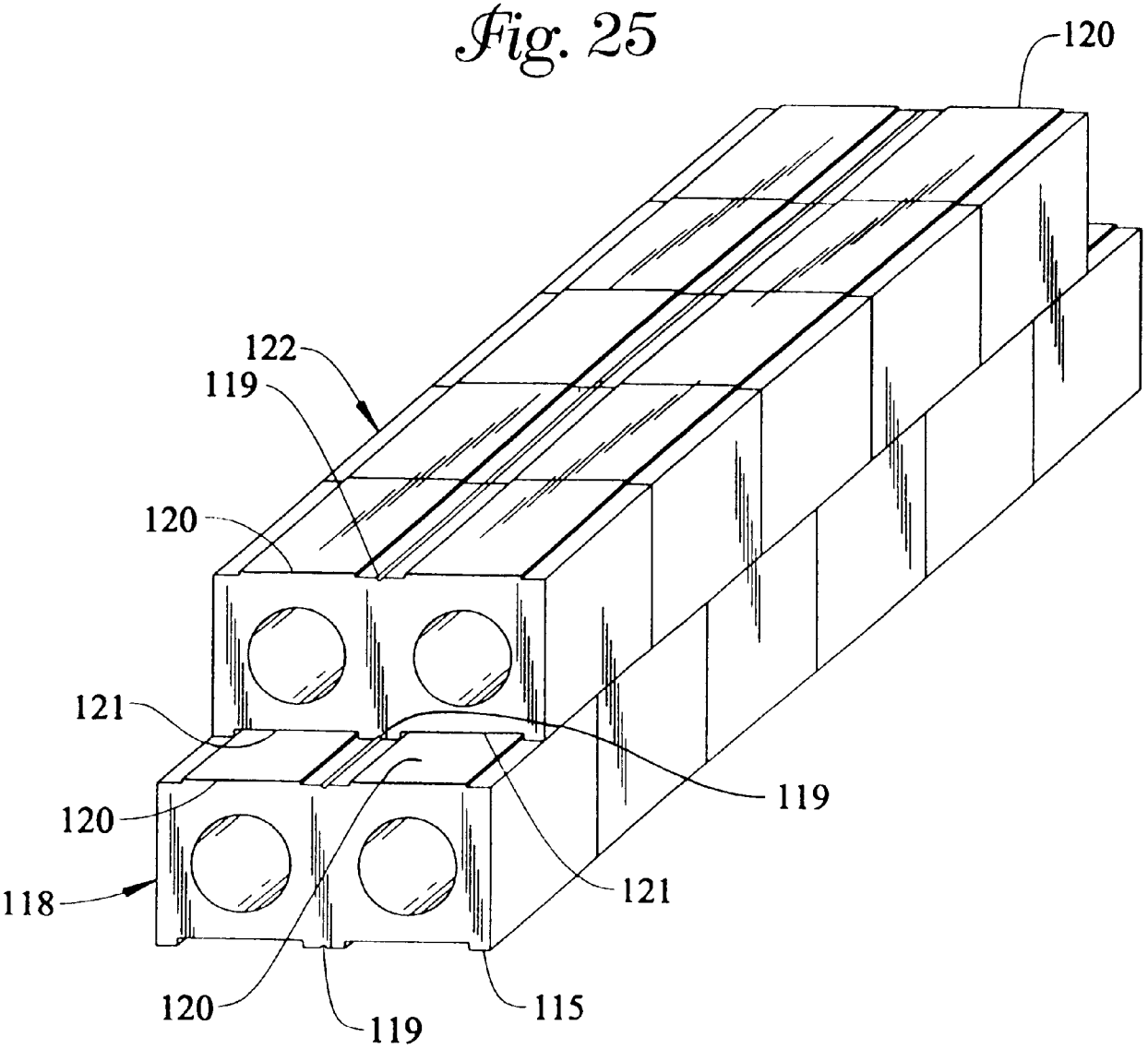
FIG. 25 is a perspective view of a wall formed with the hollow concrete blocks of FIG. 17.

When used as part of a wall 122 (see FIG. 25), the stability of the wall 122 is increased by the disposition of the two projections 120 of the hollow concrete block 118 within the two channels or grooves 121 in the bottom wall 115 of the hollow concrete block 118 thereabove when stacked on each other.

Figure 18:
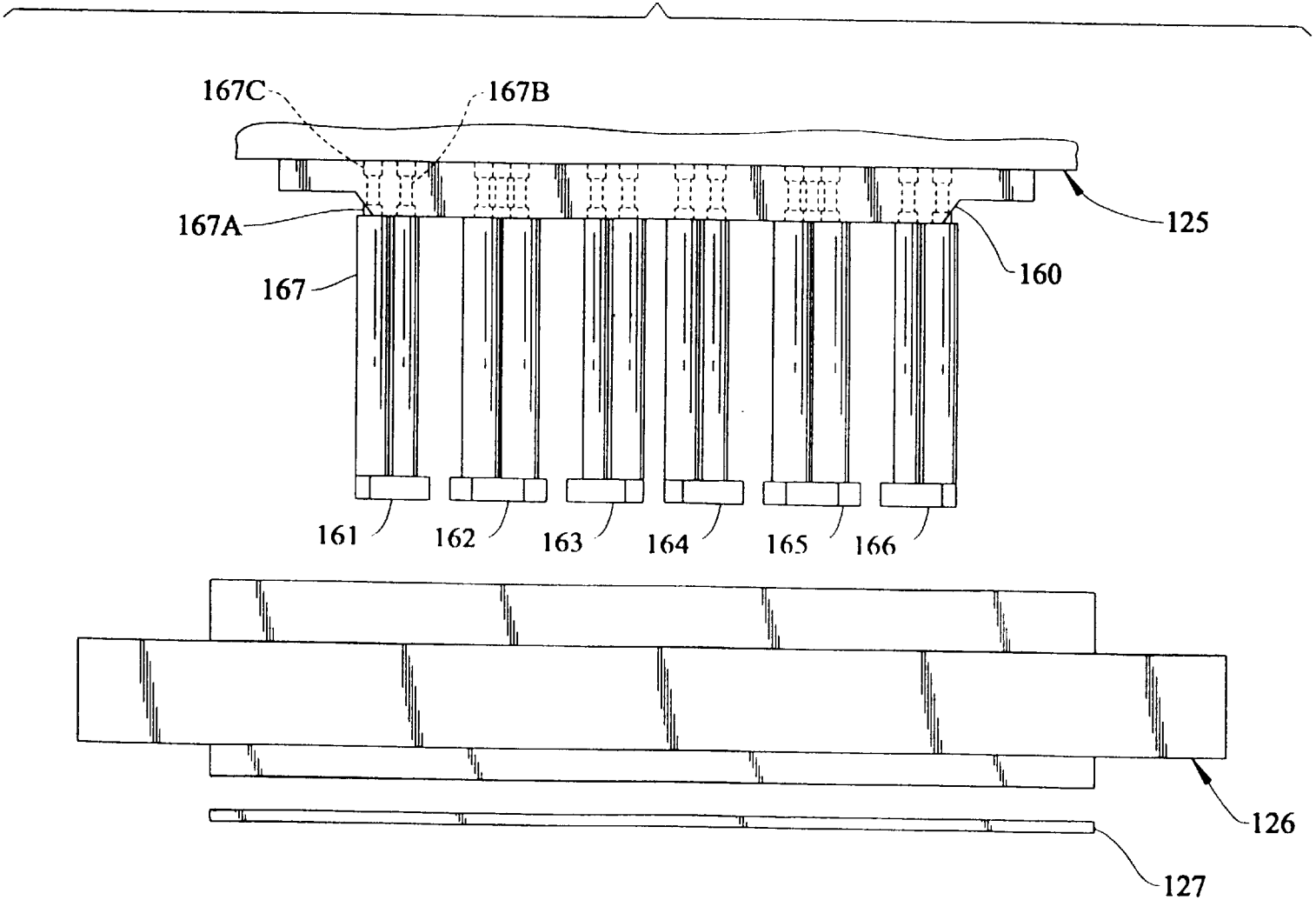
FIG. 18 is a schematic side view of portions of a block machine for forming the hollow concrete block of FIG. 17.

The hollow concrete block 118 (see FIG. 17) is preferably formed by a block machine sold as model V3-12 by Besser Equipment Company, Alpina, Mich. The block machine includes a vertically movable press head 125 (see FIG. 18), a stationary mold box 126, and a vertically movable steel pallet 127. The press head 125 and the steel pallet 127 are movable vertically relative to the stationary mold box 126 and to each other.

The mold box 126 includes two metal side frames 128 (see FIG. 19) and 129 joined together by two metal end frames 130 and 131. Bolts 131' connect the two end frames 130 and 131 to the two side frames 128 and 129. A metal divider plate 132 extends between the side frames 128 and 129 and is attached to each by bolts 133.

Figure 20:
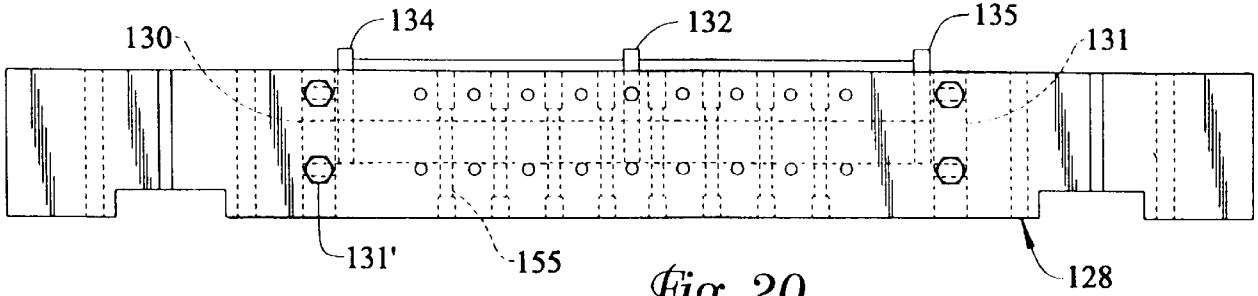
FIG. 20 is a side elevational view of the mold box of FIG. 19.

End liners 134 and 135, which are formed of metal, are attached to the end frames 130 and 131, respectively, by bolts 136. Each of the end liners 134 and 135 extends above the side frames 128 and 129 as shown in FIG. 20.

Figure 21:
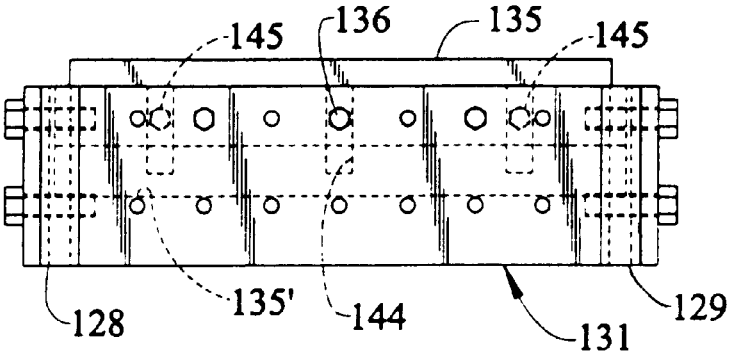
FIG. 21 is an end elevational view of the mold box of FIG. 19 and taken along line 21—21 of FIG. 19.

The end liner 135 (see FIG. 21) has lugs thereon for disposition in a recess 135' in the end frame 131. A similar arrangement exists between the end liner 134 (see FIG. 19) and the end frame 130.

Four fillers 137, which are formed of metal, are utilized with two of the fillers 137 disposed between the end liner 134 and the divider plate 132. The other two fillers 137 are positioned between the end liner 135 and the divider plate 132.

Four metal plates 137A are disposed between each of the four fillers 137 and one of the end frames 128 and 129 to fill the gaps therebetween. Two of the four metal plates 137A extend between the divider plate 132 and the liner 134, and the other two of the four metal plates 137A extend between the divider plate 132 and the liner 135. Each of the four plates 137A is attached to one of the end frames 128 and 129 by shoulder bolts 137B extending through passages 137C in each of the end frames 128 and 129 into tapped holes in the four metal plates 137A.

Three metal side liners 138, 139, and 140 are positioned between the end liner 134 and the divider plate 132. Each of the side liners 138–140 has lugs on its ends retained in recesses or slots (not shown) in the end liner 134 and the divider plate 132 and attached thereto by bolts (not shown).

Three additional metal side liners 141, 142, and 143 are disposed between the end liner 135 and the divider plate 132. Each of the side liners 141–143 has lugs on its ends retained in recesses or slots 144 (see FIG. 21) in the end liner 135 and in recesses o r slots (not shown) in the divider plate 132 (see FIG. 19).

Bolts 145 (see FIG. 21) attach the lugs on one end of each of the side liners 141–143 (see FIG. 19) to the end liner 135. Bolts (not shown) attach the lugs on the other end of each of the side liners 141–143 to the divider plate 132.

Accordingly, there are four areas in the mold box 126 in which the hollow concrete blocks 118 (see FIG. 17) may be formed. These are between the side liners 138 (see FIG. 19) and 139, the side liners 139 and 140, the side liners 141 and 142, and the side liners 142 and 143. Each of the side liners 138–143 has V-shaped projections 146 on opposite sides to form the score lines 119 (see FIG. 17) on the top wall 114 and the bottom wall 115 of each of the hollow concrete blocks 118. Each of the side liners 138–143 (see FIG. 19) may have its tolerances very closely controlled to control the tolerances of the top wall 114 (see FIG. 17) and the bottom wall 115 of the hollow concrete block 118.

To form the hollow passages 111 in the hollow concrete block 118, two cores 150 (see FIG. 22) are disposed in fixed positions within each of the four areas in which one of the hollow concrete blocks 118 (see FIG. 17) is formed. A core bar 151 (see FIG. 22) supports two of the cores 150. A core bar 152 also supports two of the cores 150.

Because eight of the cores 150 are needed, there are two of the core bars 151 and two of the core bars 152. One of each of the core bars 151 and 152 overlies the two areas between the end frame 130 (see FIG. 19) and the divider plate 132. Another of each of the core bars 151 (see FIG. 22) and 152 overlies the two areas between the end frame 131 (see FIG. 19) and the divider plate 132.

Each of the core bars 151 (see FIG. 22) and 152 has tapped holes 153 (see FIG. 23) in its two depending portions 154 for attachment to the end frames 128 (see FIG. 19) and 129 of the mold box 126. Each of the core bars 151 (see FIG. 22) and 152 has one of the depending portions 154 (see FIG. 23) disposed in a passage 155 (see FIG; 20) in the end frame 128 and the other of the depending portions 154 (see FIG. 23) disposed in a passage 156 (see FIG. 19) in the end frame 129. A shoulder bolt (not shown) extends from the bottom end of the passage 155 (see FIG. 20) and into the tapped hole 153 (see FIG. 23) to attach the core bar 151 to the end frame 128 (see FIG. 19). A similar arrangement is employed with the end frame 129. The core bars 152 (see FIG. 22) are similarly attached. While there are eight of the passages 155 (see FIG. 20) in the end frame 128 and eight of the passages 156 (see FIG. 19) in the end frame 129, only four of the passages 155 (see FIG. 20) and four of the passages 156 (see FIG. 19) are utilized since there are only two of the core bars 151 (see FIG. 22) and two of the core bars 152.

Figure 19:
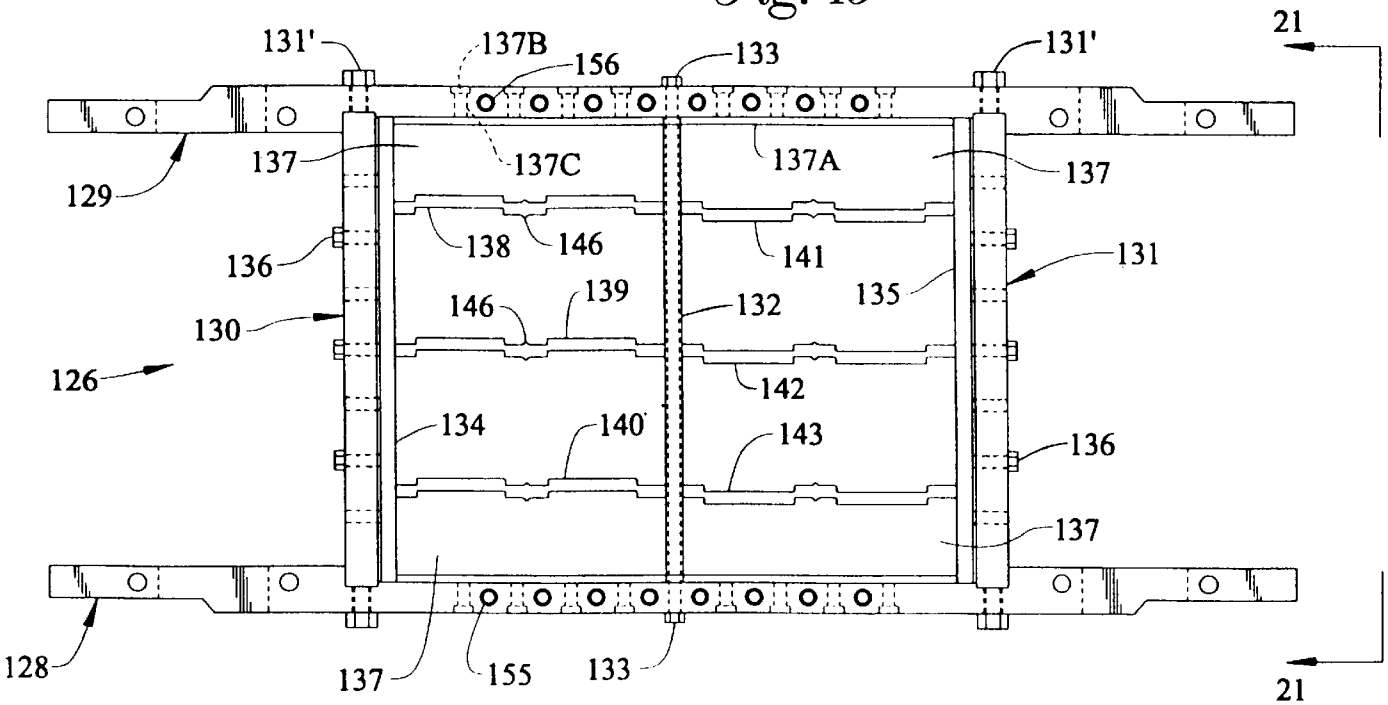
FIG. 19 is a top plan view of a mold box of a block machine used to form the hollow concrete block of FIG. 17.
Figure 23:
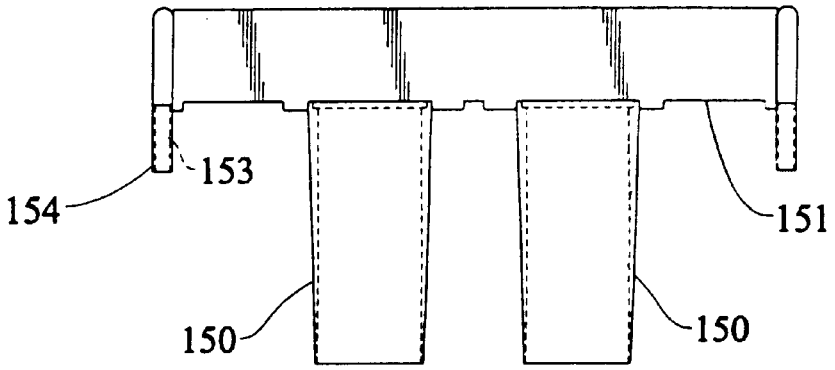
FIG. 23 is a side elevational view of one of the core bars and the two cores supported thereby.

As shown in FIG. 23, the cores 150 are tapered from their upper ends to enable easier removal of the formed hollow concrete blocks 118 (see FIG. 17) from the mold box 126 (see FIG. 19). This causes the passages 111 (see FIG. 17) to be tapered.

The press head 125 (see FIG. 24) has a head plate 160 attached thereto for movement therewith in vertical directions. The head plate 160 has a plurality of shoes 161, 162, 163, 164, 165, and 166 retained in spaced relation to the head plate 160 by steel support shafts 167.

Each of the steel support shafts 167 has a male thread on its reduced lower end for disposition within a tapped hole in one of the shoes 161–166. The upper end of each of the steel support shafts 167 is a reduced portion 167A (see FIG. 18) disposed in a passage 167B in the head plate 160. The reduced portion 167A has a tapped hole to receive a shoulder bolt 167C in the passage 167B for attaching the steel support shaft 167 to the head plate 160. This enables each of the shoes 161–166 to move with the press head 125.

Figure 24:
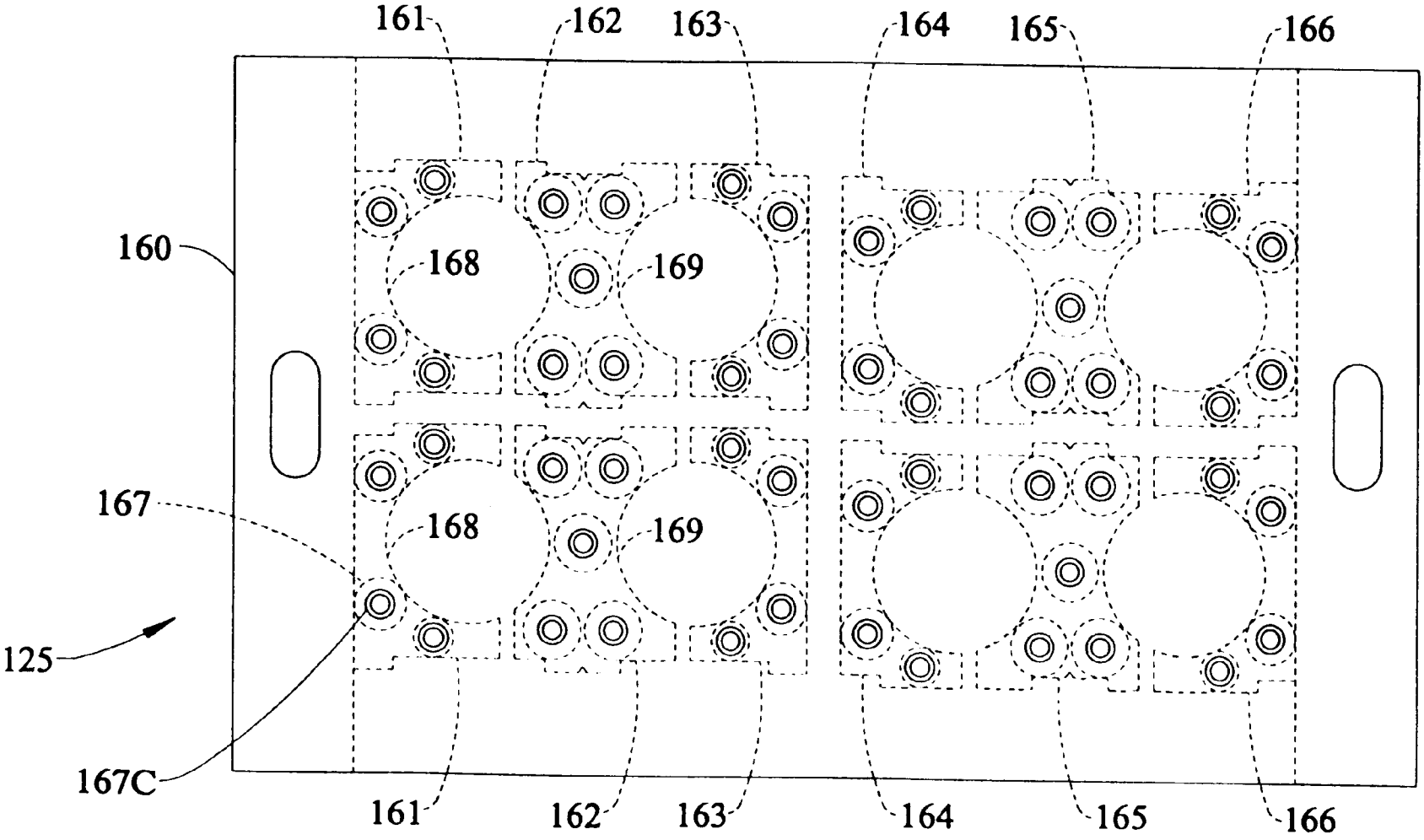
FIG. 24 is a top plan view of a portion of a press head of the block machine having shoes to engage concrete within the mold box of FIG. 19 during formation of the hollow concrete blocks of FIG. 17.

As shown in FIG. 24, the diameter of each of the steel support shafts 167 attached to the shoes 162 and 165 is larger than the diameters of the steel support shafts 167 attached to the shoes 161, 163, 164, and 166. The steel support shafts 167 attached to the shoes 161, 163, 164, and 166 are of two different diameters.

Each of the two shoes 161 cooperates with a portion of one of the two shoes 162 to form a first cylindrical opening 168 in each of the two areas between the end frame 130 (see FIG. 19) and the divider plate 132 in which one of the hollow concrete blocks 118 (see FIG. 17) is formed to receive one of the cores 150 (see FIG. 22) on one of the core bars 151. Each of the two shoes 163 (see FIG. 24) cooperates with the remaining portion of one of the shoes 162 to form a second cylindrical opening 169 in each of the two areas to receive one of the cores 150 (see FIG. 22) on one of the core bars 152.

Figure 22:
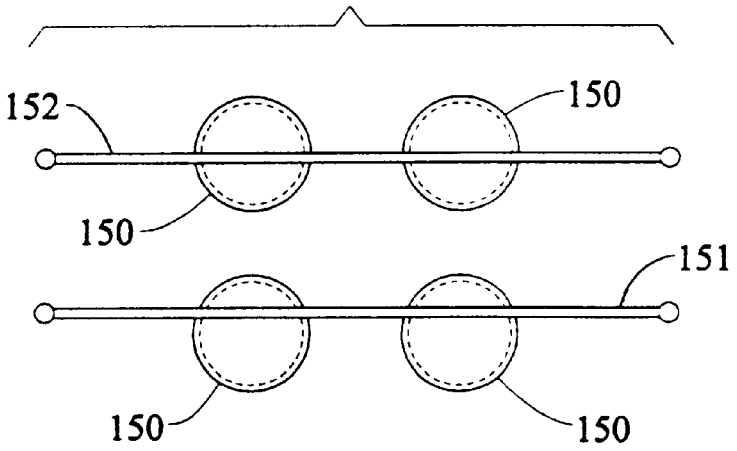
FIG. 22 is a top plan view of four cores used in the mold box of FIG. 19 and two core bars for supporting the four cores.

As shown in FIG. 24, each of the two shoes 161 is spaced from the portion of one of the two shoes 162 with which it cooperates to receive one of the core bars 151 (see FIG. 22). Each of the two shoes 163 (see FIG. 24) is spaced from the remaining portion of-one of the two shoes 162 with which it cooperates to receive one of the core bars 152 (see FIG. 22).

The shoes 164–166 (see FIG. 24) similarly cooperate with each other and the cores 150 (see FIG. 22) on the other of each of the core bars 151 and 152 in the same manner as described for the shoes 161–163 (see FIG. 24). The shoes 164–166 are disposed in the two areas between the end frame 131 (see FIG. 19) and the divider plate 132.

The steel pallet 127 (see FIG. 18) is moved upwardly to close the bottom of the mold box 126 when concrete material is deposited in the well-known manner within the top of the mold box 126. Then, the press head 125 is moved downwardly so that the shoes 161–166 will force the concrete material within the mold box 126 downwardly to compress it and form the four hollow concrete blocks 118 (see FIG. 17).

Figure 26:
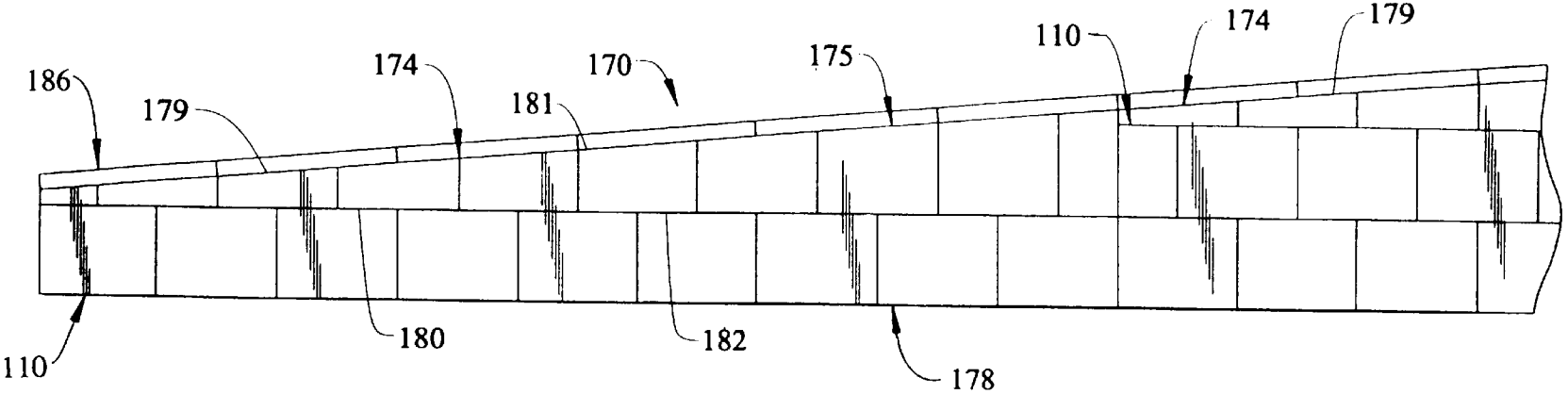
FIG. 26 is a side elevational view of another embodiment of a ramp assembly.

When the hollow concrete block 110 (see FIG. 16) is used as part of a support for a ramp assembly 170 (see FIG. 26), each of the two hollow concrete blocks 110 (see FIG. 16) has one of the projections 120 extending upwardly from the top wall 114 and one of the channels 121 formed in the bottom wall 115. It should be understood that the hollow concrete blocks 110 could be formed separately, if desired.

When the hollow concrete blocks 110 are used in place of the solid concrete blocks 24 (see FIG. 1) of the supports 23, 91 (see FIG. 13), and 92 (see FIG. 14), for example, each of the hollow concrete blocks 110 (see FIG. 16) would be formed in the shape shown for the solid concrete blocks 24 (see FIG. 1). It should be understood that the components used with the solid concrete blocks 24 could be modified so that the hollow concrete block 110 (see FIG. 16) could be used with its shape of FIG. 16.

Each of the projections 120 preferably extends upwardly from the top wall 114 a slightly smaller distance than the depth of each of the channels or grooves 121 in the bottom wall 115. This produces a space or recess 173 formed between the top of each of the projections 120 and the base of each of the channels or grooves 121 in the hollow concrete block 110 thereabove when the projection 120 is disposed in the channel or groove 121.

This allows a controlled height of construction adhesive to be easily disposed in each of the spaces or recesses 173. The controlled height is between the top of the projection 120 and the base of the channel or groove 121. Accordingly, an unskilled user may easily adhere the stacked hollow concrete blocks 118 (see FIG. 17) to each other to form the wall 122 (see FIG. 25) or the stacked hollow concrete blocks 110 (see FIG. 16) to each other for use as the supports 23 (see FIG. 1), 91 (see FIG. 13), and 92 (see FIG. 14).

Each of the hollow concrete blocks 110 (see FIG. 16) or 118 (see FIG. 17) preferably has the projection 120 extend 0.250" above the upper wall 114 and has the channel or groove 121 in the bottom wall 115 formed with a depth of 0.281". This provides the space or recess 173 (see FIG. 16) with a height of 0.031" for the construction adhesive joining the adjacent vertically stacked hollow concrete blocks 110. The tolerances of the projection 120 and the channel or groove 121 are closely controlled so that the maximum height of the recess 173 is 1/16".

It should be understood that the preferred Kapseal construction adhesive is sold in a tube having a tapered outlet spout with indicia on its exterior to indicate the inner diameter of the tapered spout along its length. This enables a user to control the diameter of the adhesive to be dispensed by cutting the spout at the selected indicia. Thus, a bead of the Kapseal construction adhesive of a specific diameter such as ⅜", for example, could be applied to each of the projections 120.

It should be understood that the projection 120 preferably has a width of 4" and the channel 121 has a width of 4.062". However, none of the adhesive in the space or recess 173 flows into the space between the sides of the projection 120 and the sides of the channel or groove 121 because of the high viscosity of the adhesive and the substantial width (4", for example) of the projection 120 in comparison with the diameter of the adhesive bead.

Thus, the bead is thicker than the height of the recess 173 but much narrower. However, the ⅜" diameter of the bead of adhesive is sufficient to join the adjacent hollow concrete blocks 110.

Figure 28:
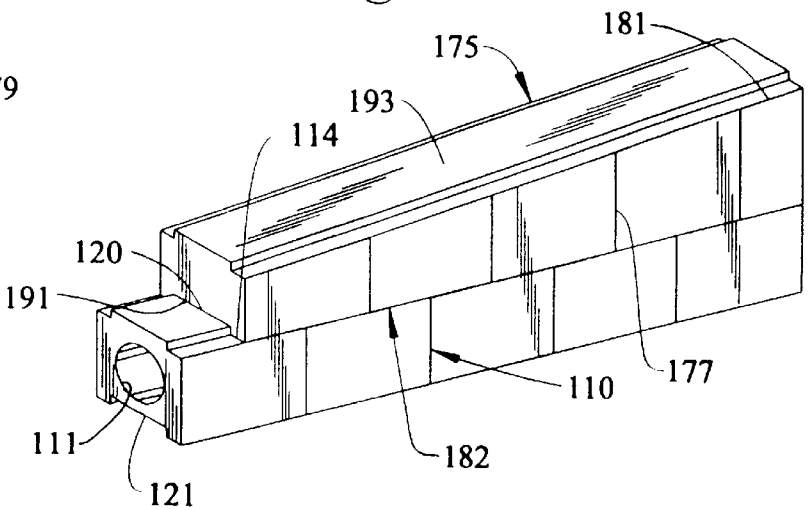
FIG. 28 is a perspective view of a larger intermediate support element of the ramp assembly of FIG. 26.
Figure 27:
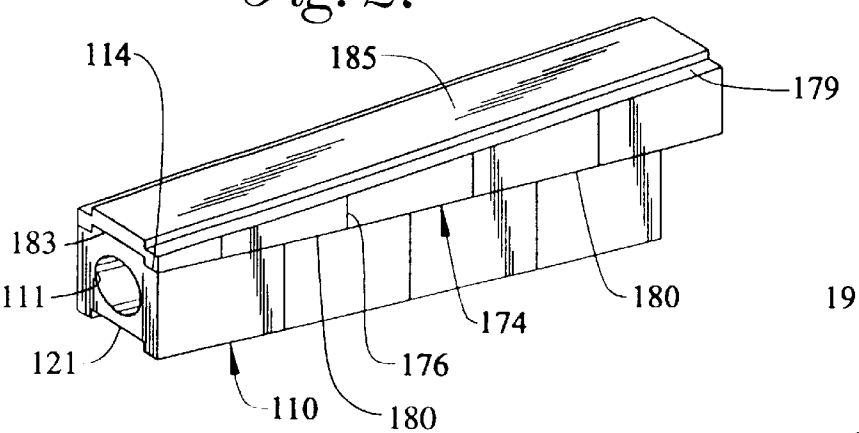
FIG. 27 is a perspective view of a smaller intermediate support element of the ramp assembly of FIG. 26.

The ramp assembly 170 (see FIG. 26) includes a smaller intermediate support element 174 and a larger intermediate support element 175. The smaller intermediate support element 174 preferably has vertical score lines 176 (see FIG. 27) thereon for aesthetic purposes, and the larger intermediate support element 175 (see FIG. 28) preferably has vertical score lines 177 thereon for aesthetic purposes although each of the score lines 176 (see FIG. 27) and 177 (see FIG. 28) may be omitted, if desired. The hollow concrete blocks 110 form supports 178 (see FIG. 26) for the smaller intermediate support elements 174 and the larger intermediate support elements 175.

By forming each of the supports 178 with only one course of the hollow concrete blocks 110 initially and then forming two staggered courses of the hollow concrete blocks 110 next, only the smaller intermediate support element 174 and the larger intermediate support element 175 are required. This is because the smaller intermediate support element 174 has an inclined upper surface 179 (see FIG. 27) spaced 1" from its substantially horizontal bottom surface 180 at its thinner end and spaced 4" from the substantially horizontal bottom surface 180 at its thicker end.

By forming the larger intermediate support element 175 (see FIG. 28) with its inclined upper surface 181 spaced 4" from its substantially horizontal bottom surface 182 at its thinner end, the inclined upper surface 181 of the larger intermediate support element 175 forms a continuation of the inclined upper surface 179 (see FIG. 27) of the smaller intermediate support element 174. The inclined upper surface 181 (see FIG. 28) has the same inclined angle to the horizontal as the inclined upper surface 179 (see FIG. 27) of-the smaller intermediate support element 174. The inclined upper surface 181 (see FIG. 28) of the larger intermediate support element 175 is disposed 7" from the substantially horizontal bottom surface 182 at its thicker end.

Therefore, when a second course of the hollow concrete blocks 110 (see FIG. 26), which have a thickness of 6", is disposed on the first course of the hollow concrete blocks 110 in staggered relation thereto, the 1" thick end of the smaller intermediate support element 174 abuts the uppermost inch of the 7" end surface of the larger intermediate support element 175. This arrangement aligns the inclined upper surface 179 of the smaller intermediate support element 174 on the second course with the inclined upper surface 181 of the larger intermediate support element 175 on the first course.

After the next of the larger intermediate support elements 175 is disposed on the top wall 114 (see FIG. 16) of the hollow concrete blocks 110 forming the second course to provide the second substantially horizontal upper surface, a third course of the hollow concrete blocks 110 is disposed in staggered relation to the second course. This is repeated until the desired length of the ramp assembly 170 (see FIG. 26) is reached. It should be understood that the smaller intermediate support element 174 may be the last of the intermediate support elements depending on the desired length.

Each of the smaller intermediate support elements 174 (see FIG. 27) has a relatively wide channel or groove 183 formed in the substantially horizontal bottom surface 180 to receive the projection 120 on the top wall 114 of each of the hollow concrete blocks 110 on which it is supported. The depth of the channel or groove 183 is made larger than the distance that the projection 120 extends upwardly from the top wall 114 of the hollow concrete block 110 in the same manner as discussed with respect to the channel or groove 121 in the hollow concrete block 110. Adhesive is similarly disposed in a recess of a controlled size formed between the projection 120 and the channel or groove 183.

Figure 29:
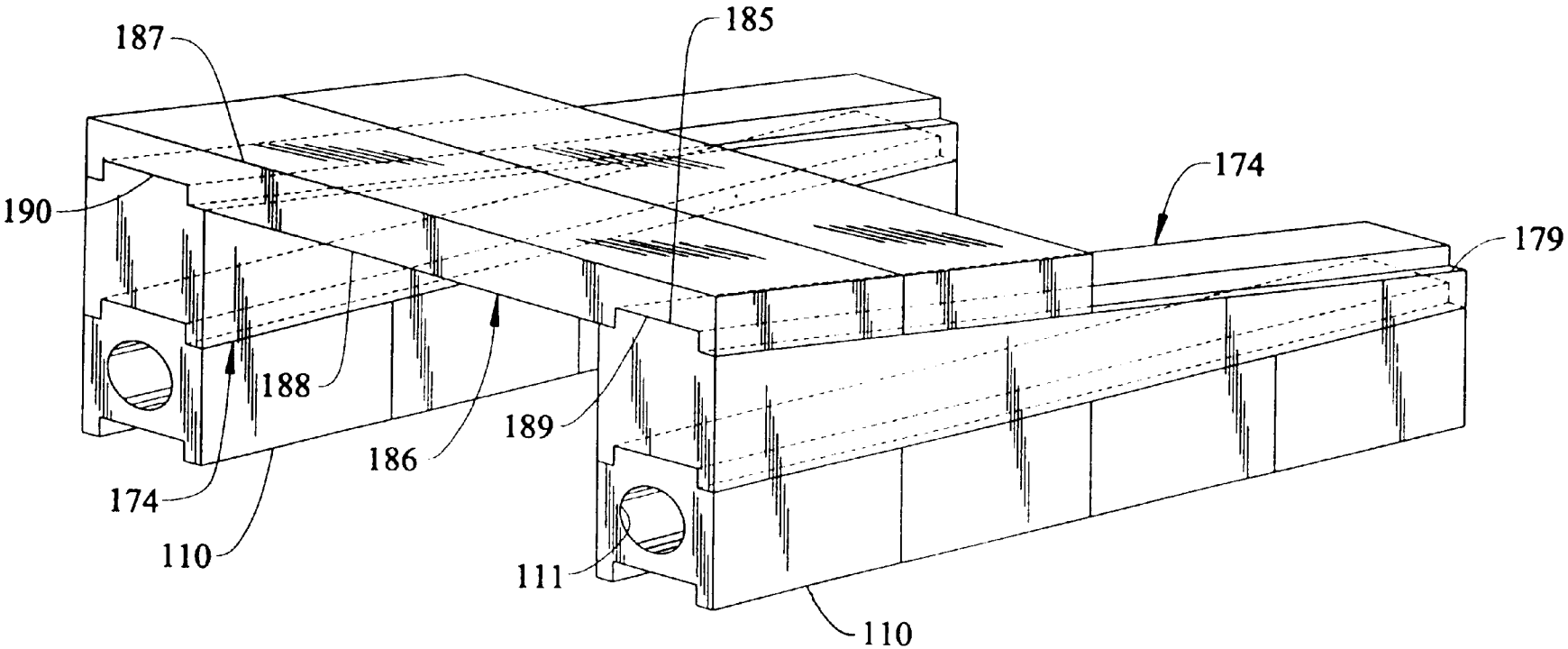
FIG. 29 is a perspective view of a portion of the ramp assembly of FIG. 26 and showing two planks supported on opposite sides by the smaller intermediate support elements.

Each of the smaller intermediate support elements 174 has a relatively wide projection 185 extending upwardly from the inclined upper surface 179. When a plank 186 (see FIG. 29), which is preferably 2" thick and has its upper surface 187 substantially parallel to its bottom surface 188, is supported at least on each side on one of the smaller intermediate support elements 174, channels or grooves 189 and 190 in the bottom surface 188 receive the projection 185. Each of the channels or grooves 189 and 190 in the bottom surface 188 of the plank 186 has a greater depth than the distance that the projection 185 extends upwardly from the inclined upper surface 179 of the smaller intermediate support element 174. Thus, a recess having a controlled size is formed therebetween to receive adhesive.

Similarly, each of the larger intermediate support elements 175 (see FIG. 28) has a relatively wide channel or groove 191 formed in the substantially horizontal bottom surface 182 to receive the projection 120 on the top wall 114 of each of the hollow concrete blocks 110 on which it is supported. The depth of the channel or groove 191 is larger than the distance that the projection 120 extends upwardly from the top wall 114 of the hollow concrete block 110 in the same manner as discussed with respect to the channel or groove 121 in the hollow concrete block 110. Adhesive is similarly disposed in a recess of a controlled size formed between the projection 120 and the channel or groove 191.

Each of the larger intermediate support elements 175 has a relatively wide projection 193 extending upwardly from the inclined upper surface 181. When one of the planks 186 (see FIG. 29) is supported at least on each side on one of the larger intermediate support elements 175 (see FIG. 28), each of the channels or grooves 189 (see FIG. 29) and 190 in the bottom surface 188 receives one of the projections 193 (see FIG. 28). Each of the channels or grooves 189 (see FIG. 29) and 190 in the bottom surface 188 of the plank 186 has a greater depth than the distance that the projection 193 (see FIG. 28) extends upwardly from the inclined upper surface 181 of the larger intermediate support element 175. Thus, a recess of a controlled size is formed therebetween to receive adhesive.

It should be understood that the hollow concrete block 118 (see FIG. 17) is 6" high between the top wall 114 and the bottom wall 115, 12" wide between the side walls 116 and 117, and 8" deep between the end walls 112 and 113. When the hollow concrete block 118 is split into two of the hollow concrete block 110 (see FIG. 16), the side wall 116 (see FIG. 17) of the hollow concrete block 118 is the side wall 116 (see FIG. 16) of one of the two hollow concrete blocks 110, and the side wall 117 of the hollow concrete block 118 (see FIG. 17) is the side wall 117 (see FIG. 16) of the other of the two hollow concrete blocks 110.

The maximum tolerance between the top wall 114 (see FIG. 17) of the hollow concrete block 118 and the bottom wall 115 is 1/16" and is the same for each of the two hollow concrete blocks 110 (see FIG. 16) formed therefrom. The maximum tolerance between the side walls 116 (see FIG. 17) and 117 of the hollow concrete block 118 is 1/16" so that the maximum tolerance between the side walls 116 (see FIG. 16) and 117 of either of the two split hollow concrete blocks 10 1could be 1/16" but the sum of the maximum tolerances between the side walls 116 and 117 of both of the two split hollow concrete blocks 1can only be 1/16".

It should be understood that each of the intermediate support elements 174 (see FIG. 26) and 175 and the plank 186 preferably has a length of three feet.

It also should be understood that any of the hollow concrete blocks 1or 118 (see FIG. 17) could be formed with any desired aesthetic appearance. For example, any of the hollow concrete blocks 110 (see FIG. 16) or 118 (see FIG. 17) could have the stone face 30 (see FIG. 1) as shown on the solid concrete block 24.

An advantage of this invention is that it is easily assembled. Another advantage of this invention is that no cement or mortar has to be mixed or applied for use in joining parts together. A further advantage of this invention is that a minimum number of interrupted surfaces is employed. Still another advantage of this invention is that the tread has a simple rectangular shape. A still further advantage of this invention is that it is economical to manufacture. Yet another advantage of this invention is that the ramp assembly has a relatively lower cost. A yet further advantage of this invention is that an aesthetic wall of hollow concrete blocks can be erected without any mortar.

For purposes of exemplification, particular embodiments of the invention have been shown and described according to the best present understanding thereof. However, it will be apparent that changes and modifications in the arrangement and construction of the parts thereof may be resorted to without departing from the spirit and scope of the invention.

We claim:

1. A step assembly comprising:

first and second supports spaced apart in substantially parallel arrangement, each support having a first layer having at least one block, each block having:

a top surface spaced apart from a substantially parallel bottom surface, thereby defining a block thickness;

opposed and substantially parallel first and second walls having a length, the top and bottom surfaces and the first and second walls being configured to define a longitudinal axis;

opposed and substantially parallel first and second ends separated by the length;

the top surface, the bottom surface, the first and second walls and the first and second ends together forming a block body; and wherein the top surface has a projection extending therefrom and the bottom surface has a groove that engages the projection of the top surface of an underlying block, thus forming an interlocking arrangement;

a first riser having opposed upper and lower surfaces, opposed front and rear surfaces, and first and second ends;

a first tread having a substantially planar top surface and an opposed and substantially parallel bottom surface, opposed front and rear surfaces, and first and second ends; the bottom surface having first and second grooves, wherein the rear surface of the first riser abuts against the first end of a block in the first layer of the first support and against the first end of a block in the first layer of the second support, and wherein the first and second grooves on the bottom surface of the first tread engage the projections on the top surfaces of the blocks in the first layer of the first and second supports, so that the first layer, the first riser, and the first tread form a first step of the step assembly.

2. The step assembly of claim 1 wherein the first and second supports have a second layer having at least one block and wherein the step assembly further comprises:

a second riser having opposed upper and lower surfaces and opposed front and rear surfaces and first and second ends;

a second tread having a substantially planar top surface and an opposed and substantially parallel bottom surface, opposed front and rear surfaces, and first and second ends; the bottom surface having first and second grooves, wherein the rear surface of the second riser abuts against the first end of a block in the second layer of the first support and against the first end of a block in the second layer of the second support, and wherein the first and second grooves on the bottom surface of the second tread engage the projections on the top surfaces of the blocks in the second layer of the first and second supports;

that the second layer, the second riser, and the second tread form a second step of the step assembly.

3. The step assembly of claim 1 wherein each block further has a core extending through the block body substantially parallel to the longitudinal axis.

4. The step assembly of claim 1 further comprising adhesive between the first and second grooves on the bottom surface of the first tread and the projections on the top surfaces of the blocks in the first layer of the first and second supports.

* * * * *